US007462052B2

(12) United States Patent
Karton

(10) Patent No.: US 7,462,052 B2
(45) Date of Patent: Dec. 9, 2008

(54) LAMP AND SOCKET ASSEMBLY WHICH PREVENTS INSTALLATION OF AN INCANDESCENT LAMP

(76) Inventor: Richard L. Karton, 735 S. Settlers Cir., Warrington, PA (US) 18976

( * ) Notice: Subject to any disclaimer, the term of this patent is extended or adjusted under 35 U.S.C. 154(b) by 0 days.

(21) Appl. No.: 11/624,832

(22) Filed: Jan. 19, 2007

(65) Prior Publication Data

US 2007/0167053 A1 Jul. 19, 2007

Related U.S. Application Data

(60) Provisional application No. 60/760,345, filed on Jan. 19, 2006.

(51) Int. Cl.
*H01R 33/02* (2006.01)

(52) U.S. Cl. ..... 439/236; 439/240; 439/242; 439/615

(58) Field of Classification Search ..... 439/236, 439/240, 242, 611, 615, 619, 667
See application file for complete search history.

(56) References Cited

U.S. PATENT DOCUMENTS 4,093,333 A * 6/1978 Tjornhom, Sr. ..... 439/306
4,683,402 A * 7/1987 Aubrey ..... 315/56
5,286,216 A * 2/1994 Volz ..... 439/236
5,380,214 A * 1/1995 Ortega, Jr. ..... 439/253
5,634,820 A * 6/1997 Vakil ..... 439/646
5,653,527 A * 8/1997 Muessli ..... 362/650
5,700,154 A * 12/1997 Geary ..... 439/236
6,036,522 A * 3/2000 Holzer ..... 439/306
6,099,144 A 8/2000 Klaus
6,380,683 B1 * 4/2002 Kahn ..... 315/56
6,652,305 B1 * 11/2003 DiFusco ..... 439/255
6,905,225 B2 6/2005 Pearl
7,053,540 B2 * 5/2006 Bobel ..... 313/318.1
7,121,891 B2 * 10/2006 Cherian ..... 439/615
7,125,159 B2 * 10/2006 Hirsch et al. ..... 362/651
7,178,969 B1 * 2/2007 Shiang et al. ..... 362/650
7,198,505 B2 * 4/2007 Cherian ..... 439/419

OTHER PUBLICATIONS

TCP (Technical Consumer Products, Inc.); Catalog of Lighting Innovation + Shining New Light on Things; 2006; p. 10; Aurora, OH.
International Search Report to counterpart PCT Application No. PCT/US07/60686; Mailed Feb. 8, 2008; 4 pages.

* cited by examiner

*Primary Examiner*—Renee S Luebke
*Assistant Examiner*—Vanessa Girardi
(74) *Attorney, Agent, or Firm*—Panitch Schwarze Belisario & Nadel LLP

(57) ABSTRACT

A lamp is configured for removable insertion into a socket assembly. The lamp includes a light source and a housing. The housing has a proximate end and a distal end. The light source is attached to the proximate end. The housing has an aperture at the distal end. The socket assembly includes a post. The aperture is sized to receive the post when the lamp is inserted into the socket assembly.

19 Claims, 8 Drawing Sheets

*B-B*

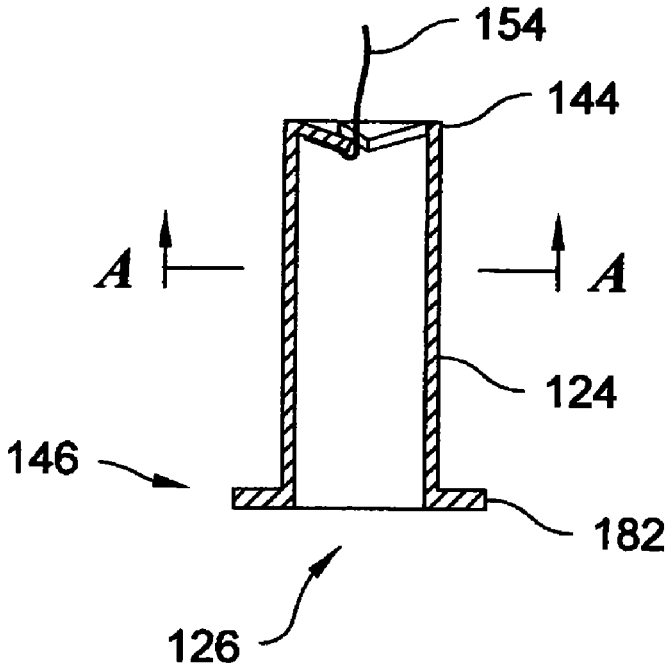
*Fig. 8A*
*Fig. 8B*
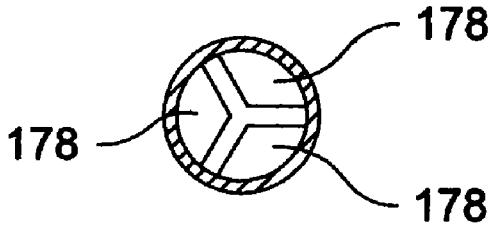
*A-A*

LAMP AND SOCKET ASSEMBLY WHICH PREVENTS INSTALLATION OF AN INCANDESCENT LAMP

CROSS-REFERENCE TO RELATED APPLICATIONS

The present application claims the benefit of U.S. Provisional Patent Application No. 60/760,345, filed Jan. 19, 2006 and entitled "Screw Base and Socket for Lamp", the entire subject matter of which is hereby incorporated by reference.

BACKGROUND OF THE INVENTION

The present application is directed to a compatible lamp and socket assembly and, more particularly, to a screw socket assembly constructed to prevent the installation of conventional screw based lamps into the socket assembly, and a lamp having a screw base compatible with the socket assembly.

As a matter of public policy, it is preferable to use compact fluorescent lamps (CFL) for lighting because of their power saving attributes. Conventional CFL's use a standard E26 screw base in order to be compatible with standard household light fixtures. Accordingly, a standard household light fixture will operate satisfactorily with either an incandescent lamp or a CFL. However, even if CFL's are promoted for use with a given standard light fixture, a consumer may insert an incandescent or other conventional lamp into the fixture, thus obviating the energy saving feature promoted for the fixture.

It would be desirable to create a specifically designed socket assembly, and compatible lamp, such that when the socket assembly is installed in a light fixture, the installation of a conventional incandescent lamp is prevented. Furthermore, it would be desirable that the compatible lamp may still be used with standard sockets compatible with E26 screw bases.

BRIEF SUMMARY OF THE INVENTION

Briefly stated, the present invention is directed to a lamp including a housing having an aperture in a distal end of the housing. The aperture is sized to receive a post when the lamp is inserted into a socket.

In another aspect, the present invention is directed to a socket assembly for receiving a lamp. The socket assembly includes a socket and a shell. The shell includes a contact having a non-conducting post mounted thereon.

BRIEF DESCRIPTION OF THE SEVERAL VIEWS OF THE DRAWINGS

The foregoing summary, as well as the following detailed description of a preferred embodiment of the present invention, will be better understood when read in conjunction with the appended drawings. For the purpose of illustrating the invention described in the present application, there is shown in the drawings, an embodiment which is presently preferred. It should be understood, however, that the invention is not limited to the precise arrangements and instrumentalities shown. In the drawings:

FIG. 8A is a cross-sectional front elevation view of a sleeve of the second preferred embodiment thereof shown in an operative position and electrically connected to a first lead;

FIG. 8B is a bottom plan view of the sleeve thereof, taken along line A-A of FIG. 8A;

DETAILED DESCRIPTION OF THE INVENTION

Figure 1:
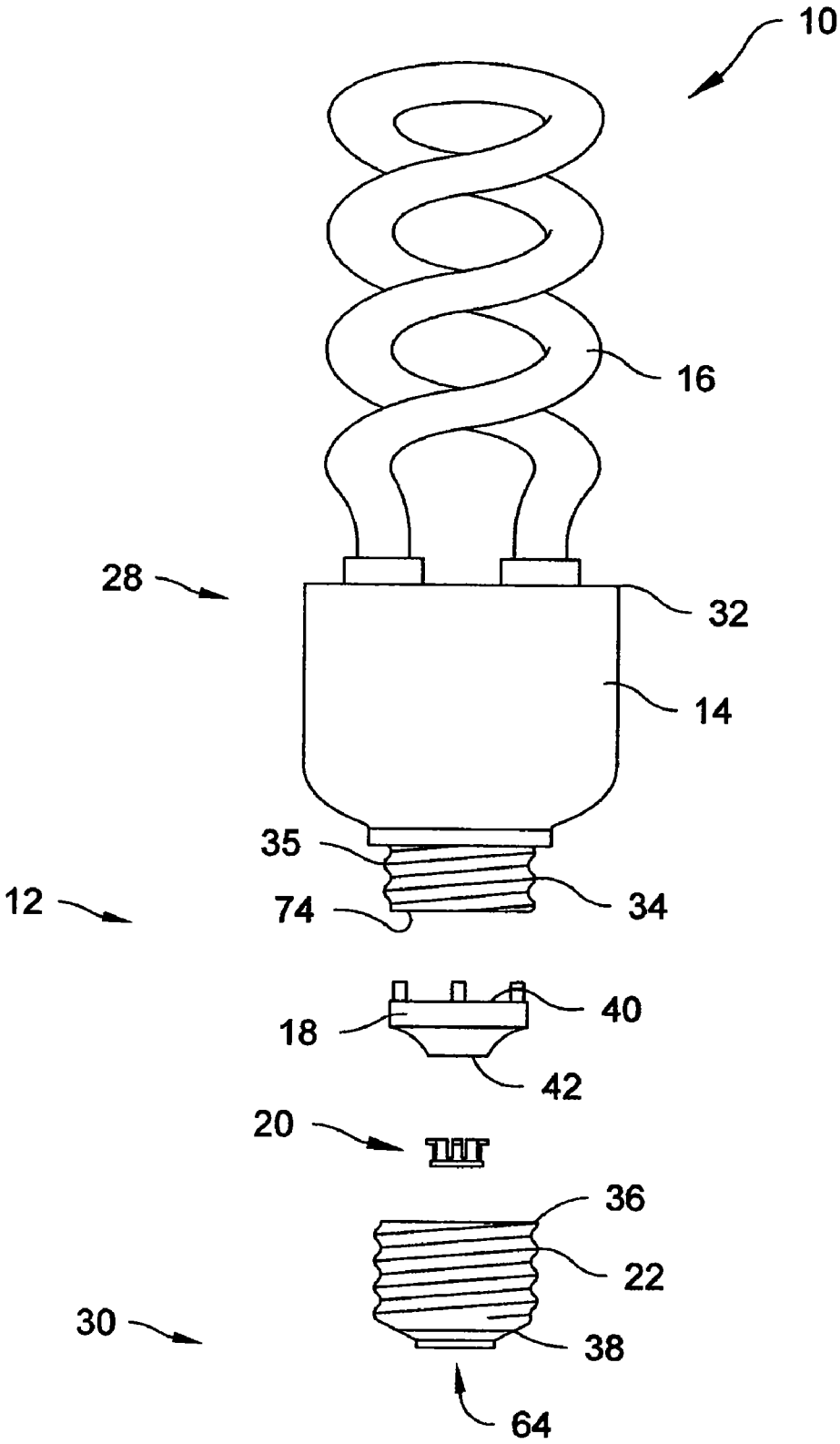
FIG. 1 is a exploded front elevation view of a first preferred embodiment of a lamp in accordance with the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the dispensing blender and designated parts thereof. The terminology includes the above-listed words, derivatives thereof and words of similar import.

Figure 9A:
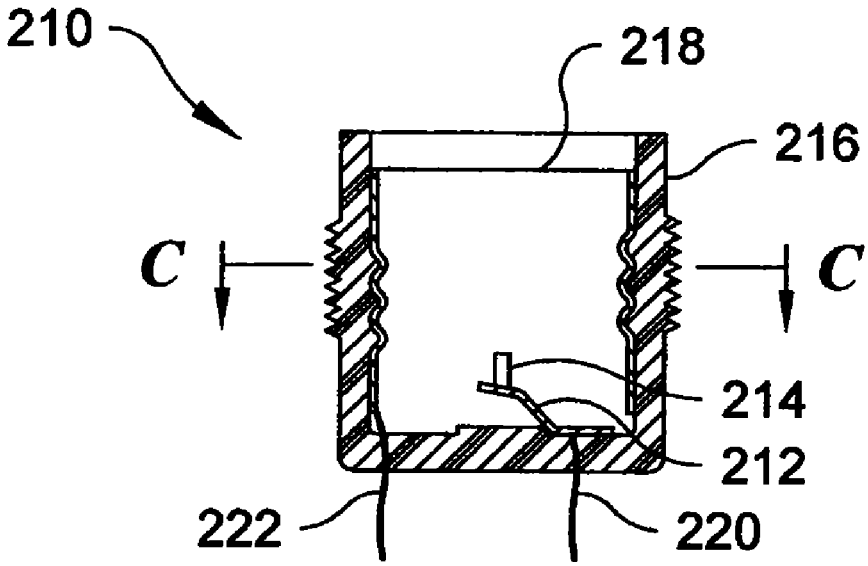
FIG. 9A is a cross-sectional front elevation view of a socket assembly in accordance with the present invention.
Figure 9B:
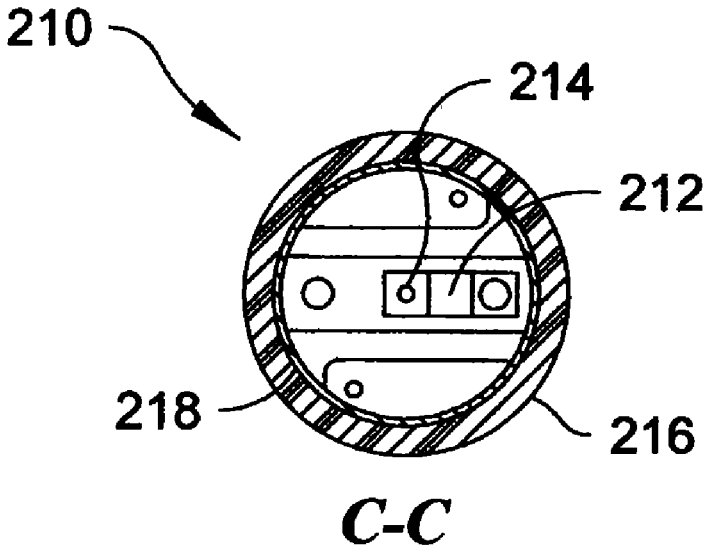
FIG. 9B is a top plan view thereof.

Referring now to the drawings in detail, wherein like numerals are used to indicate like elements throughout, there is shown in FIGS. 1-5B a first preferred embodiment of a lamp, generally designated 10, for use with a specifically designed socket assembly 210 (as shown in FIGS. 9A and 9B and described in detail below) in accordance with the present invention. The lamp 10 is preferably in the form of a conventional compact fluorescent lamp (CFL), but could be any other type of lamp, including a light emitting diode lamp, a gas discharge lamp, a halogen lamp or even an incandescent lamp. The lamp 10 includes a housing 12 having an upper, proximate end 28 and a lower, distal end 30. The housing 12 includes an aperture 26 in the distal end 30 of the housing 12. The aperture 26 is sized to receive a post 214 (as shown in FIGS. 9A and 9B) when the lamp 10 is inserted into the socket assembly 210.

The housing 12 includes a case 14 for securing a bulb 16. The case 14 has a flat, upper end 32 and a lower attachment end 34 with an interior side wall 74. Preferably, the attachment end 34 has an outer screw thread 35. The case 14 is preferably formed of a high strength, nonconductive polymeric material. However, it is understood by those skilled in the art that the case 14 can be constructed of a variety of materials that exhibit high strength and nonconductive characteristics without departing from the spirit and scope of the invention.

In the first preferred embodiment, a CFL bulb 16 is mounted in a conventional manner to the flat end 32 of the electrically insulating case 14. However, it is understood by those skilled in the art that any light producing mechanism, such as described above, can be mounted to the case 14 without departing from the spirit and scope of the invention. Where required, an electronic ballast circuit, typically on a circuit board 48, is located within the case 14. Leads 50, 52 connect the bulb 16 to the output of the ballast circuit. First and second leads 54 and 56 extend from the input of the ballast circuit for connection to a voltage supply line, as described below.

Figure 3:
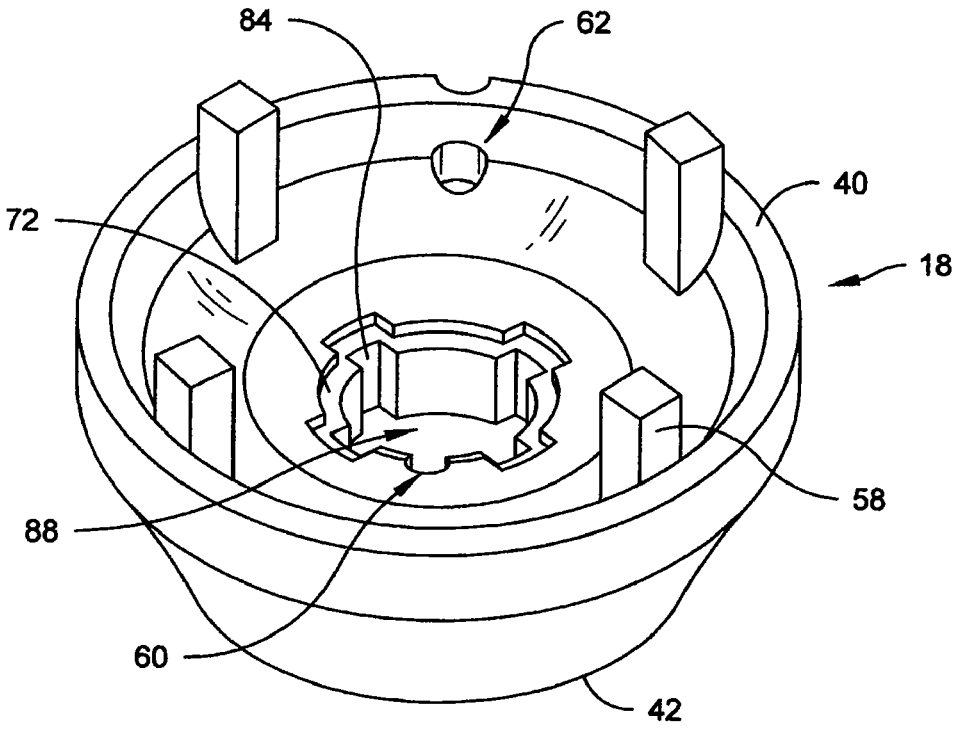
FIG. 3 is a top perspective view of an adapter of the first preferred embodiment thereof.
Figure 4:
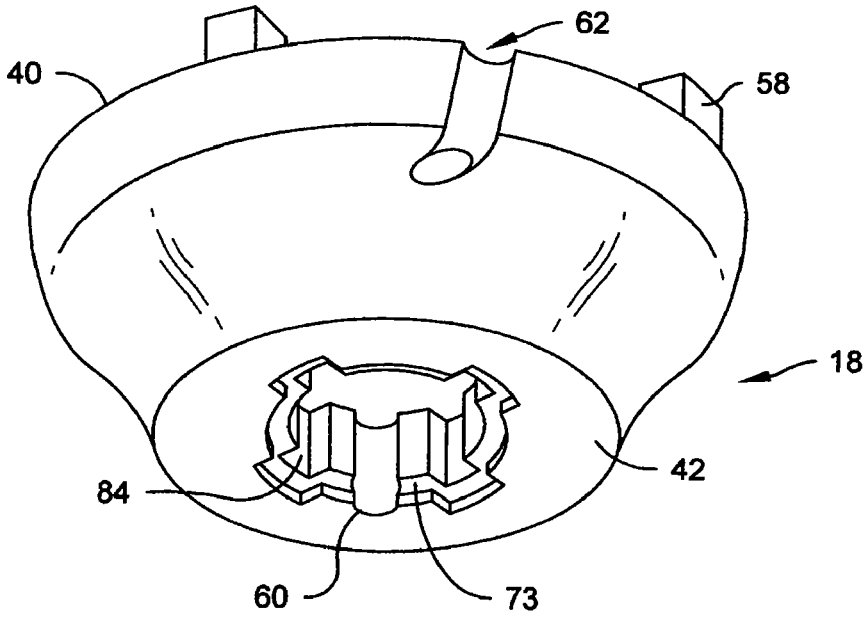
FIG. 4 is a bottom perspective view of the adapter thereof.

In reference to FIGS. 3 and 4, the housing 12 further includes an adapter 18 having a centrally located opening 88. The adapter 18 is removably attached to the attachment end 34 of the case 14. The adapter 18 is preferably formed of a nonmetallic, insulating material, such as a polycarbonate. However it is understood by those skilled in the art that the adapter 18 can be constructed of a variety of materials that exhibit nonconductive characteristics, such as a polymeric material, without departing from the spirit and scope of the invention.

In the first preferred embodiment, the adapter 18 includes a plurality of tabs 58. The tabs 58 project from a top end 40 of the adapter 18 and engage the interior side wall 74 of the attachment end 34 of the case 14. The tabs 58 allow the top end 40 of the adapter 18 to be properly positioned and flush against the attachment end 34 of the case 14. Although the first preferred embodiment discloses four tabs 58 projecting from the top end 40 of the adapter 18, it is understood by those skilled in the art that any number of tabs 58 can be used that allow the adapter 18 to be properly positioned against the case 14. Further, it is understood by those skilled in the art that the shape of the taps 58 is not limited to that shown in the figures. For example, the size and shape of the tabs 58 can be in any form that allows the adapter 18 to easily and firmly connect to the case 14.

The opening 88 of the adapter 18 further includes a plurality of slots 84, a groove 60 and upper and lower recesses 72, 73. The plurality of slots 84 extend the entire length of the opening 88. In the first preferred embodiment, the plurality of slots 84 are equidistantly spaced around the circumference of the opening 88. The plurality of slots 84 are preferably rectangular in shape. However, it is understood by those skilled in the art that the shape, location and size of the plurality of slots 84 can be modified without departing from the spirit and scope of the invention. For example, the plurality of slots 84 can be modified to include only two slots 84 on opposite sides of the opening 88. Further, the shape of the slots 84 can be of any form, such as triangular. The groove 60 extends the entire length of the opening 88 and is located at the circumference of the opening 88 between any pair of the plurality of slots 84. The groove 60 is generally sized and shaped to receive the first lead 54.

A through hole 62 extends from an interior of the adapter 18 to an exterior side wall of the adapter 18. The through hole 62 of the adapter 18 is generally sized and shaped to receive the second lead 56. The through hole 62 is generally U-shaped and provides a passageway between the interior and exterior of the adapter 18. The through hole 62 maintains the proper positioning of the second lead 56 when the lamp 10 of the first preferred embodiment is in the assembled configuration. However, it is understood by those skilled in the art that the size, shape and location of the through hole can be modified without departing from the spirit and scope of the invention.

Figure 5A:
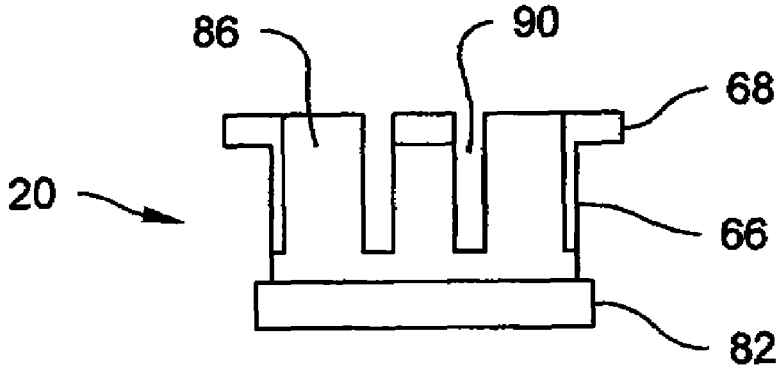
FIG. 5A is a front elevation view of an insert of the first preferred embodiment thereof.
Figure 5B:
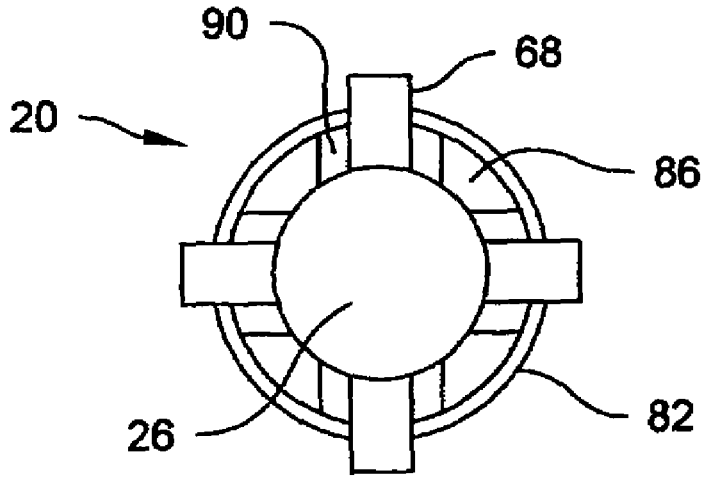
FIG. 5B is a top plan view of the insert thereof.

Referring now to FIGS. 5A and 5B, the housing 12 further includes an insert 20, which includes the aperture 26. The insert 20 is positioned in the opening 88 of the adapter 18. The insert 20 is preferably formed of an elastic and conductive material, such as copper or a copper alloy. However, it is understood by those skilled in the art that the insert 20 can be constructed of a variety of materials that exhibit elastic and conductive characteristics, such as brass, aluminum, nickel-plated copper or any other metallic material, without departing from the spirit and scope of the invention. The insert 20 is generally sized and shaped to fit securely within the opening 88 of the adapter 18.

The insert 20 includes a flange 82 at a lower portion of the insert 20 with fingers 66 and elastically resilient portions 86 extending therefrom. A lip 68 generally extends perpendicular from a top end of each finger 66. In the assembled configuration of the lamp 10, each of the fingers 66 engage one of the plurality of slots 84 in the opening 88 of the adapter 18. The fingers 66, lips 68 and the elastically resilient portions 86 are equidistantly spaced around the circumference of the flange 82 of the insert 20. A spacing 90 separates each elastically resilient portion 86 from each finger 66. The flange 82 is generally sized and shaped to fit within the lower recess 73 of the adapter 18 and each lip 68 is generally sized and shaped to fit within the upper recess 72 of the adapter 18 when the insert 20 is positioned within the opening 88 of the adapter 18.

Figure 2A:
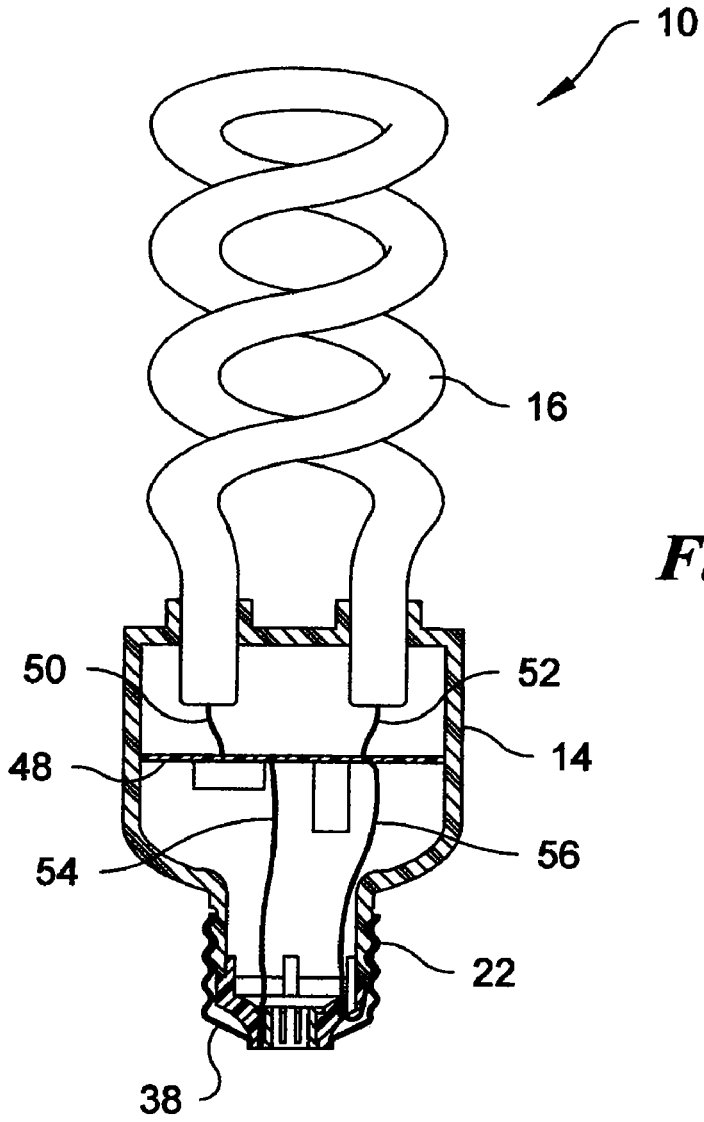
FIG. 2A is a cross-sectional front elevation view of the assembled first preferred embodiment of the lamp shown in FIG. 1.
Figure 2B:
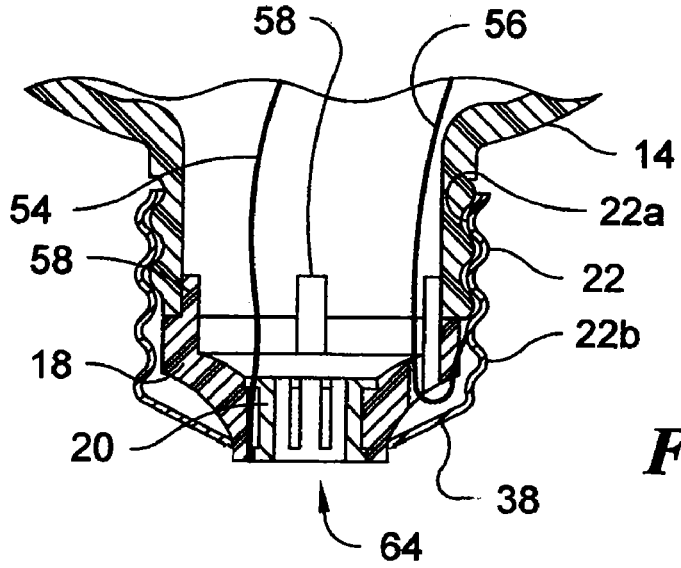
FIG. 2B is a magnified cross-sectional view of a distal end of a housing of the first preferred embodiment thereof.

In reference to FIGS. 1-2B, the housing 12 further includes a screw coupling 22 attached to the attachment end 34 of the case 14. The screw coupling 22 is generally sized and shaped to fit over the insert 20, the adapter 18 and the attachment end 34 of the case 14 when the lamp 10 is in the assembled configuration. The screw coupling 22 is made of a metallic material and has an inner and outer screw thread 22*a*, 22*b*. The screw coupling 22 has a bottom, connection end 38 with an opening 64 therein. Further, the screw coupling 22 has an upper, open end 36. When the lamp 10 of the first preferred embodiment is in the assembled configuration (as shown in FIGS. 2A and 2B), the inner screw thread 22*a* of the screw coupling 22 engages the screw thread 35 of the case 14. Further, in the assembled configuration of the first preferred embodiment, at least a portion of the adapter 18 is within the opening 64 and extends slightly below the connection end 38 of the screw coupling 22. The screw coupling 22 is preferably formed of a metallic material, such as nickel-plated copper, for its conductive characteristics. However, it is understood by those skilled in the art that the screw coupling 22 can be constructed of a variety of materials that exhibit conductive characteristics, such as brass or aluminum, without departing from the spirit and scope of the invention.

In the first preferred embodiment, the first and second leads 54, 56 are each operatively connected to the bulb 16 either via the ballast circuit and leads 50, 52 or directly. In the assembled configuration of the first preferred embodiment, the first lead 54 is captivated by the elastically resilient portion 86 of the insert 20. Further, the second lead 56 is captivated between the adapter 18 and the screw coupling 22.

In a preferred method of assembling the various pieces of the lamp 10 of the first preferred embodiment (as shown in FIGS. 1-2A), a manufacturer first positions the insert 20 within the adapter 18. Specifically, the manufacturer slides the insert 20 into the opening 88 through the bottom end 42 of the adapter 18 making sure to align the fingers 66 of the insert 20 with the plurality of slots 84 of the adapter 18. The manufacturer slides the insert 20 within the opening 88 of the adapter 18 until the lip 68 of each finger 66 passes through the slot 84 and engages the upper recess 72 proximate the top end 40 of the adapter 18. In this position, the flange 82 of the insert 20 is positioned within the lower recess 73 at the bottom end 42 of the adapter 18.

Once the insert 20 is properly positioned within the adapter 18, the manufacturer next connects the first and second leads 54, 56 from within the case 14 to the adapter 18 and insert 20. Specifically, a manufacturer places the free end of the second lead 56, which extends from within the attachment end 34 of the case 14, into the through hole 62 of the adapter 18 such that the free end of the second lead 56 makes a U-shape from the interior of the adapter 18 to an exterior of the adapter 18 (as shown in FIGS. 2A and 2B). The manufacturer then places the free end of the first lead 54, which also extends from within the attachment end 34 of the case 14, through the groove 60 in the opening 88 of the adapter 18. Specifically, the manufacturer pushes the free end of the first lead 54 through the groove 60 such that an elastically resilient portion 86 is pushed inward toward the center of the opening 88. As the manufacturer places the first lead 54 through the groove 60, the elastic resilient portion 86 of the insert 20 establishes an electrical connection between the insert 20 and the first lead 54, which is operatively connected to the bulb 16.

Once the first and second leads 54, 56 are properly connected from within the attachment end 34 of the case 14 to the adapter 18 and the insert 20, the manufacturer positions the tabs 58 of the adapter 18 within the attachment end 34 of the case 14 such that the top end 40 of the adapter 18 is flush against the bottom of the attachment end 34 of the case 14. As described above, the tabs 58 frictionally engage the interior side wall 74 of the case 14 to properly position the adapter 18 and insert 20 against the attachment end 34 of the case 14.

Next, the manufacturer screws the screw coupling 22 over the adapter 18 and attachment end 32 of the case 14 and then permanently fixes the screw coupling 22 to the case 14 by crimping. Specifically, the inner thread 22*a* of the screw coupling 22 engages the screw thread 35 of the case 14. In the assembled configuration of the first preferred embodiment, the screw coupling 22 surrounds the insert 20, adapter 18 and attachment end 34 of the case 14 such that the screw coupling 22 appears to be the lower extension of the case 14. Now that the lamp 10 of the first preferred embodiment is in the assembled configuration, the lamp 10 is ready to be operatively connected to the specifically designed socket assembly 210 (as shown in FIGS. 9A and 9B).

Referring now to FIGS. 6-8B, there is shown a second preferred embodiment of a lamp, generally designated 110, for use with the specifically designed socket assembly 210 (as shown in FIGS. 9A and 9B) in accordance with the present invention. The housing 112 of the lamp 110 of the second preferred embodiment is generally similar to the housing 12 of the lamp 10 of the first preferred embodiment (as shown in FIGS. 1-5B). The housing 112 of the second preferred embodiment includes a case 114 and a screw coupling 122 substantially similar to the case 14 and screw coupling 122 of the first preferred embodiment. Further, the housing 112 has an aperture 126 in a distal end of the housing 112. The aperture 126 is sized to receive the post 214 (as shown in FIGS. 9A and 9B) when the lamp 110 is inserted into the socket assembly 210. However, the housing 112 of the second preferred embodiment is different from the housing 12 of the first preferred embodiment in that the adapter 18 and insert 20 are omitted and replaced by a sleeve 124.

Referring to FIGS. 8A and 8B, the sleeve 124 has an upper and lower end 144, 146. The aperture 126 and a flange 182 are located in the lower end 144 and at least on spring flap 178 is located in the upper end 144. The sleeve 124 is preferably formed of a resilient and conductive material, such as copper or a copper alloy. However, it is understood by those skilled in the art that the sleeve 124 can be constructed of a variety of materials that exhibit elastic and conductive characteristics, such as brass, aluminum, nickel-plated copper or any other metallic material, without departing from the spirit and scope of the invention.

The sleeve 124 is generally sized and shaped to be fastened within an opening 164 of the screw coupling 122. Specifically, the sleeve 124 is cylindrical in form. The aperture 126 is generally sized and shaped to receive the post 214 of the socket assembly 210 (as shown in FIGS. 9A and 9B and described in detail below). The flange 182 generally extends perpendicularly outward from the lower end 146 of the sleeve. The at least one spring flap 178 generally extends perpendicularly inward from the upper end 144 of the sleeve 124. In the second preferred embodiment, three spring flaps 178, each being triangular in shape, are formed in the upper end 144 of the sleeve 124. These three spring flaps 178 are slightly depressed during assembly of the lamp 110 to form a small opening through which the first lead 154 can be inserted. The small opening formed by the spring flaps 178 is smaller than the aperture 126 at the lower end 146 of the sleeve 124. It is understood by those skilled in the art that the number and shape of the spring flaps 178 can be modified, to more easily and securely fasten the first lead 154 to the sleeve 124, without departing from the spirit and scope of the invention.

Figure 7A:
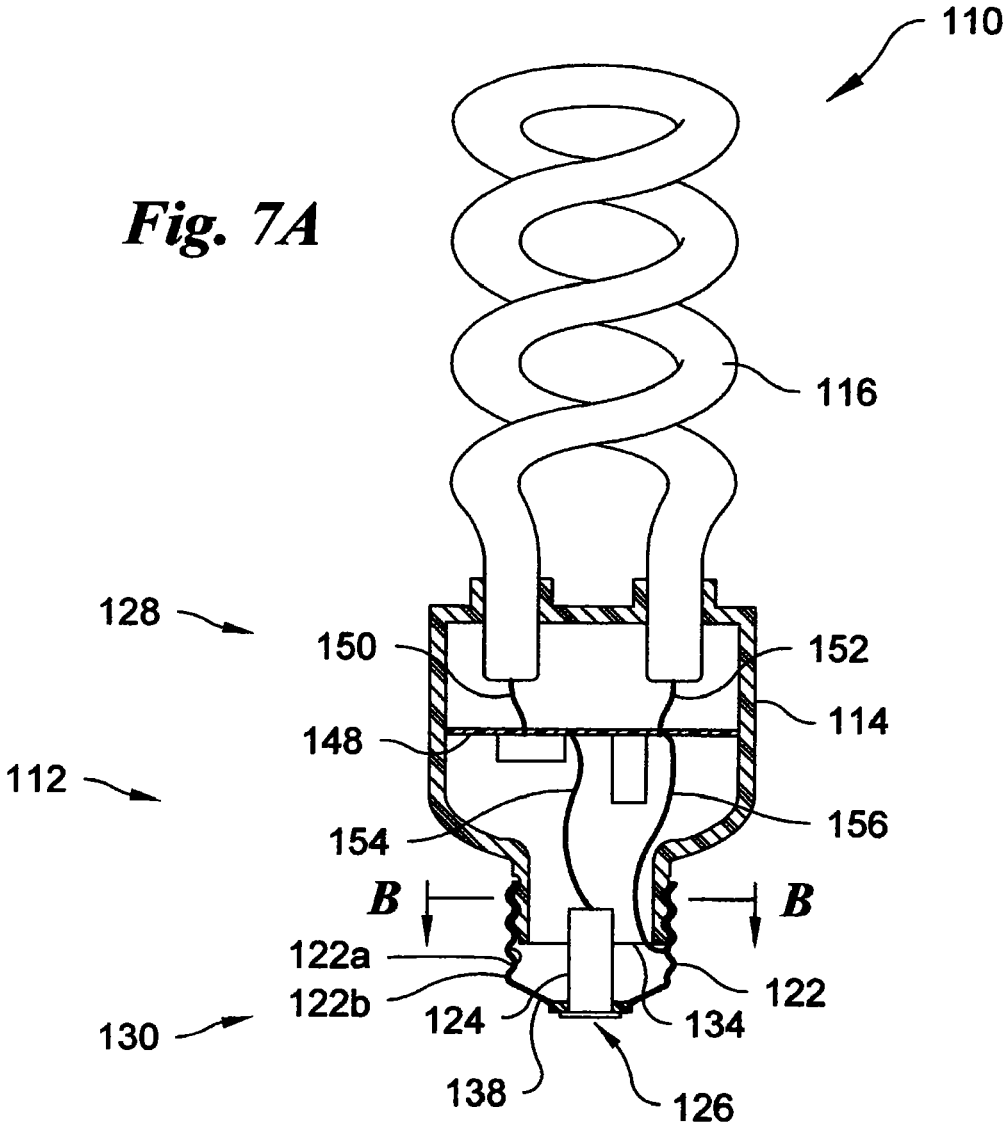
FIG. 7A is a cross-sectional front elevation view of the assembled second preferred embodiment of the lamp shown in FIG. 6.
Figure 7B:
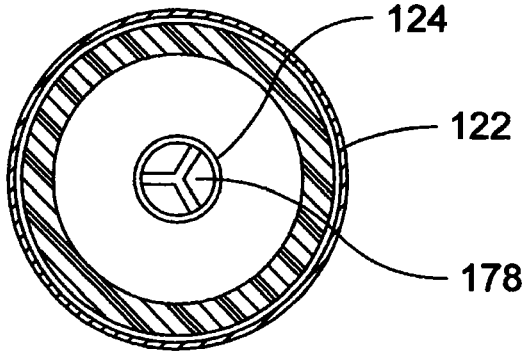
FIG. 7B is a magnified top plan view of a distal end of a housing of the second preferred embodiment thereof, taken along line B-B of FIG. 7A.

Referring to FIG. 7A, as in the first preferred embodiment, first and second leads 154, 156 of the second preferred embodiment are operatively connected to a bulb 116. However, in the second preferred embodiment, the first lead 154 is captivated by the at least one spring flap 178 and the second lead 156 is captivated between the case 114 and the screw coupling 122. Specifically, the first lead 154 is captivated by the crimping action of the spring flaps 178 attempting to return to their original, horizontal position after the spring flaps 178 have been slightly depressed. This configuration establishes an electrical connection between the first lead 154 and the sleeve 124. The second lead 156 is held in place between the case 114 and the screw coupling 122 to properly ground the lamp 110.

In a preferred method of assembling the various pieces of the lamp 110 of the second preferred embodiment (as shown in FIG. 7A), a manufacturer first positions the sleeve 124 within the screw coupling 122. Specifically, the manufacturer slides the upper end 144 of the sleeve 124 into an opening 164 of the screw coupling 122 until the flange 182 at the bottom end 144 of the sleeve 124 contacts the outer periphery of the opening 164. The flange 182 of the sleeve 124 is then fastened to the screw coupling 122. In the second preferred embodiment, the sleeve 124 is separated from the screw coupling 122 by an insulator 138 at a lower end of the screw coupling 122. It is understood by those skill in the art that the insulator 138 can be formed of any material, such as glass, epoxy or a polymeric material, which properly secures the sleeve 124 to the screw coupling 122 without departing from the spirit and scope of the invention.

Once the sleeve 124 is properly positioned within and fastened to the screw coupling 122, a manufacturer next connects the first and second leads 154, 156 from within the case 114 to the sleeve 124 and between the case 114 and screw coupling 122, respectively. Specifically, a manufacturer places the first lead 154, which extends from within an attachment end 134 of the case 114, through the small opening created by the depression of the flaps 178 (as shown in FIG. 8A). A manufacturer also lays the second lead 156 on the exterior surface of the attachment end 134 of the case 114.

Next, a manufacturer fastens the screw coupling 122 over the attachment end 132 of the case 114 making sure to captivate the second lead 156 between the case 114 and the screw coupling 122. Specifically, the inner thread 122 of the screw coupling 122 engages the screw thread 135 of the case 114 and the screw coupling 122 is crimped to the case 114. Now that the lamp 110 of the second preferred embodiment is in the assembled configuration, the lamp 110 is ready to be operatively connected to the specifically designed socket assembly 210 (as shown in FIGS. 9A and 9B).

Figure 6:
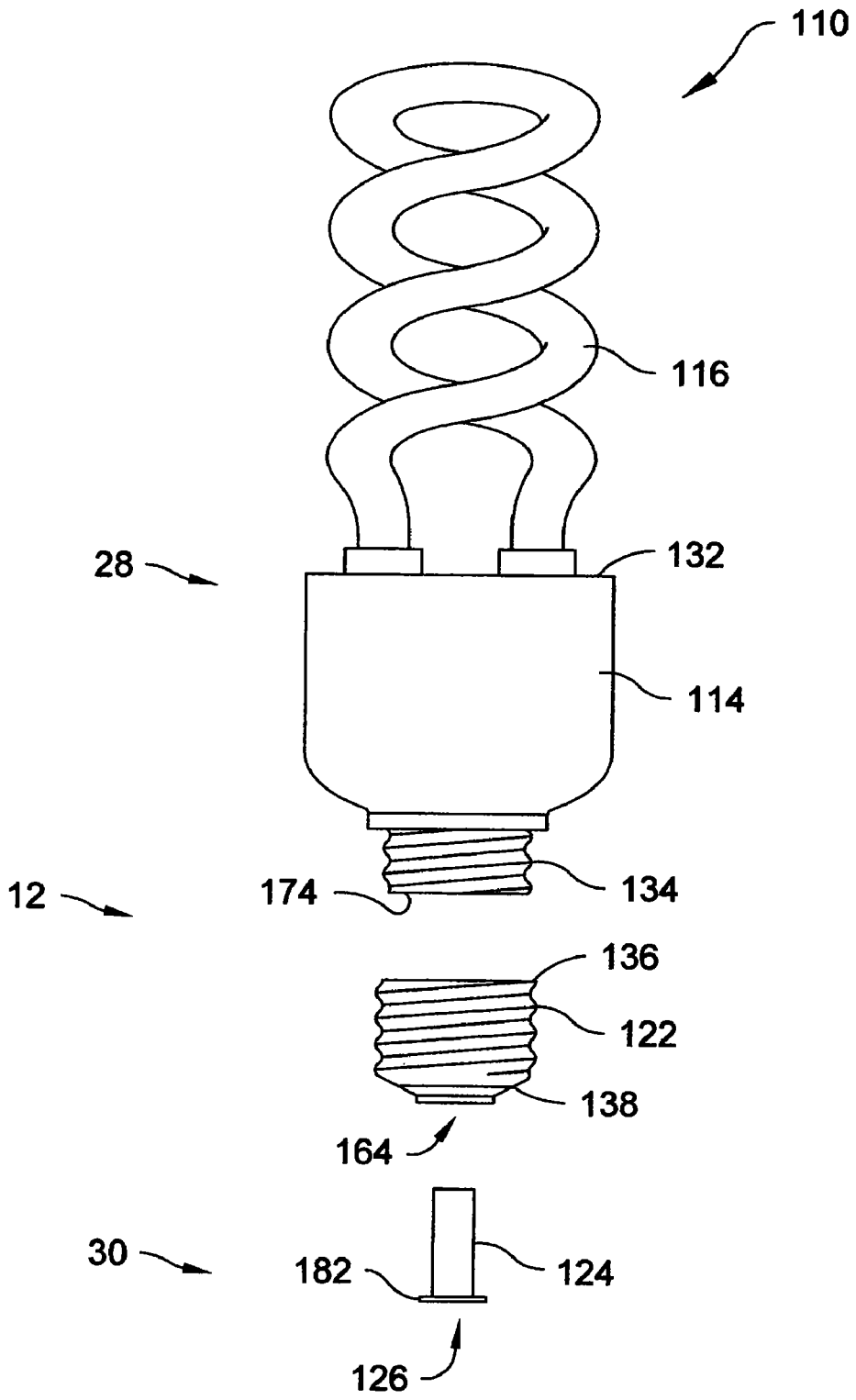
FIG. 6 is a exploded front elevation view of a second preferred embodiment of a lamp in accordance with the present invention.

Referring now to FIGS. 9A and 9B, there is shown a preferred embodiment of a socket assembly, generally designated 210, for electrically connecting to a specifically designed lamp 10, 110 (as shown in FIGS. 2 and 6). The socket 218 is generally cylindrical in form and size to fit within the shell 216. The socket assembly 210 includes a socket 218 and a shell 216. The socket 218 is preferably formed of a conductive material, such as nickel-plated copper. However, it is understood by those skilled in the art that the socket 218 can be constructed of a variety of materials that exhibit conductive characteristics, such as aluminum, brass or any metallic alloy, without departing from the spirit and scope of the invention.

The shell 216 is preferably formed of a high strength, nonconductive and insulating material, such as porcelain. However it is understood by those skilled in the art that the shell 216 can be constructed of a variety of materials that exhibit insulating characteristics, such as acrylonitrile butadiene styrene (ABS) or any polycarbonate, without departing from the spirit and scope of the invention. The shell 216 is generally cylindrical in shape and sized to receive the socket 218. The shell 216 includes a contact 212 having a non-conducting post 214 mounted therein. The contact 212 is located within a lower interior of the socket 218 when the socket 218 is positioned within the shell 216. In the preferred embodiment, the contact 212 comprises a spring. As shown in FIG. 9A, the spring is generally in the form of a leaf spring. However, it is understood by those skilled in the art that the contact can be formed of any type of spring, such as a coil spring or any other object with conductive characteristics. Further, it is understood by those skilled in the art that the contact 212 is not limited by just one spring. For example, the contact 212 can be comprised of a plurality of springs.

The post 214 extends through the opening of the socket 218 when the socket 218 is located within the insulating shell 216. In the preferred embodiment, a lower end of post 214 is mounted on the contact 212. An upper end of the post 214 extends in the interior of the socket 218 towards a top open end of the socket 218. The post 214 is preferably formed of an insulating material, such as a polycarbonate material. However, it is understood by those skilled in the art that the post 214 can be constructed of a variety of materials, such as any polymeric material, that exhibit insulating characteristics without departing from the spirit and scope of the invention. The post 214 is positioned at a center of the shell 216 to prevent a base of a conventional light bulb (not shown) from electrically connecting to the spring 212.

The socket assembly 210 further includes a first lead 220 that is operatively connected to the spring 212 and a second lead 222 connected to the socket 218. The first lead 220 of the socket assembly 210 is essentially a hot wire lead and the second lead 222 of the socket assembly 220 is essentially a ground wire lead. The socket assembly 210 is essentially a conventional socket assembly from meeting with an E26 screw base except for the addition of the post 214 attached to the contact 212.

It would be understood by those skilled in the art that the shape and size of the socket assembly 210 can be in a variety of forms to receive the screw coupling 22, 122 of the lamp 10, 110. For example, the socket assembly 210 is not limited to a standard E26 medium screw base, but could be any other size of screw base, extending from miniature to mogul base. Further, the socket assembly 210 of the present invention could be easily adapted to a bayonet screw base. It is understood by those skilled in the art that the same concept is equally applicable to other size housings 12, 112 and to bayonet type housings 12, 112. Further, it is understood by those skilled in the art that the lamp 10, 110 of either the first or second preferred embodiment may still be used with standard sockets compatible with E26 screw bases since the flange 82 of the insert 20 or the flange 182 of the sleeve 124 is capable of establishing an electrical connection with a contact of a standard socket.

When the lamp 10, 110 of either the first or second preferred embodiment is screwed into the socket assembly 210, the post 214 extends into the aperture 26, 126 of either the insert 20 of the first preferred embodiment or the sleeve 124 of the second preferred embodiment. This configuration allows the flange 82 of the insert 20 of the first embodiment or the flange 182 of the sleeve 124 of the second preferred embodiment to contact the spring 212 and form an electrical connection between the power supply (not shown) and the bulb 116. Conversely, if a lamp having a standard E26 screw base is screwed into the socket assembly 210 of the preferred embodiment, the post 214 prevents an electrical connection from being made at the bottom of the standard screw base.

It will be appreciated by those skilled in the art that changes could be made to the embodiments described above without departing from the broad inventive concept thereof. It is understood, therefore, that this invention is not limited to the particular embodiments disclosed but is intended to cover modifications within the spirit and scope of the present invention as defined by the pending claims.

I claim:

1. A lamp configured for removable insertion into a socket assembly, said lamp comprising:

a light source;

a case having an upper end and an attachment end, said light source being secured to the case at the upper end; and a screw coupling having an upper end and a bottom end, said screw coupling being fixedly secured to the attachment end of the case and having an opening in the bottom end, said opening being sized to receive a post when said lamp is inserted into the socket assembly.

2. The lamp of claim 1, wherein the light source is a light emitting diode.

3. The lamp of claim 1, wherein the light source is a fluorescent lamp.

4. The lamp of claim 1, wherein the light source is a gas discharge lamp.

5. The lamp of claim 1, wherein the light source is an incandescent lamp.

6. The lamp of claim 1, further comprising:

an adapter engaging the attachment end of said case, said adapter having a centrally located opening coaxially arranged with the opening of said screw coupling; and an insert, coaxially arranged within the opening of said adapter.

7. The lamp of claim 6, said adapter comprising a plurality of tabs, said tabs projecting from a top end of said adapter and engaging said interior sidewall of said attachment end of said case.

8. The lamp of claim 6, wherein at least a portion of said adapter is within the opening of said screw coupling.

9. The lamp of claim 8, further including first and second leads each of which is operatively connected to said light source, said first lead being captivated by an elastically resilient portion of said insert and said second lead being captivated between said adapter and said screw coupling.

10. The lamp of claim 9, said adapter further comprising a plurality of slots in said opening and a through hole, said through hole being sized to receive said second lead.

11. The lamp of claim 10, said insert further comprising a flange with fingers extending therefrom, each of said fingers engaging one of said plurality of slots in said opening of said adapter.

12. The lamp of claim 1, said screw coupling further comprising:

an annular insulator surrounding the opening of the screw coupling; and a hollow sleeve, having an upper end, a lower end and a flange at said lower end, said sleeve being fastened to said annular insulator and extending through said opening of said screw coupling.

13. The lamp of claim 12, said sleeve further comprising three spring flaps at said upper end.

14. The lamp of claim 12, said sleeve further comprising at least one spring flap at said upper end.

15. The lamp of claim 14, further including first and second leads each of which is operatively connected to said light source, said first lead being captivated by said at least one spring flap and said second lead being captivated between said case and said screw coupling.

16. A socket assembly for receiving a lamp, said socket assembly comprising:

a socket; and a non-conductive shell surrounding said socket, said shell including an electrical contact, said contact having a non-conducting post mounted thereon, wherein said post is positioned at a center of said shell to prevent a base of a lamp not having an aperture in a socket end from electrically connecting to said electrical contact.

17. The socket assembly of claim 16, said post extending through an opening in said socket.

18. The socket assembly of claim 16, wherein said electrical contact comprises a leaf spring.

19. A socket assembly comprising:

a non-conductive shell;

a centrally located electrical contact attached to the non-conductive shell; and a non-conductive post mounted onto the contact such that the post occupies an area which is less than an area of the contact;

wherein if a lamp including a centrally located aperture is received by the socket assembly, an electrical connection is made between the electrical contact and the lamp and if a lamp not including a centrally located aperture is received by the socket assembly, an electrical connection between the electrical contact and the lamp assembly is prevented.

* * * * *